US008596966B1

(12) United States Patent
Liang

(10) Patent No.: US 8,596,966 B1
(45) **Date of Patent: *Dec. 3, 2013**

(54) TURBINE VANE WITH DIRT SEPARATOR

(75) Inventor: George Liang, Palm City, FL (US)

(73) Assignee: Florida turbine Technologies, Inc., Jupiter, FL (US)

( * ) Notice: Subject to any disclaimer, the term of this patent is extended or adjusted under 35 U.S.C. 154(b) by 20 days.

This patent is subject to a terminal disclaimer.

(21) Appl. No.: 13/415,022

(22) Filed: Mar. 8, 2012

Related U.S. Application Data

(63) Continuation of application No. 12/489,030, filed on Jun. 22, 2009, now Pat. No. 8,142,153.

(51) Int. Cl.
*F01D 5/18* (2006.01)
*F01D 25/00* (2006.01)

(52) U.S. Cl.
USPC ..... 415/169.1; 416/97 R

(58) Field of Classification Search
USPC ..... 415/115, 169.1, 209.4; 416/95, 96 A, 416/96 R, 97 R
See application file for complete search history.

(56) References Cited

U.S. PATENT DOCUMENTS

| | | | | |
|---|---|---|---|---|
| 6,435,813 | B1 * | 8/2002 | Rieck et al. | 415/115 |
| 6,874,988 | B2 * | 4/2005 | Tiemann | 415/115 |
| 8,142,153 | B1 * | 3/2012 | Liang | 416/1 |
| 2006/0133923 | A1 * | 6/2006 | Paauwe et al. | 415/115 |

* cited by examiner

*Primary Examiner* — Edward Look
*Assistant Examiner* — Jason Davis
(74) *Attorney, Agent, or Firm* — John Ryznic

(57) ABSTRACT

A turbine stator vane with a cooling circuit that improves the cooling effectiveness of the airfoil as well as collects any dirt particles before passing the clean cooling air through the cooling circuit. The airfoil includes a 3-pass aft flowing serpentine circuit with a first leg located along the airfoil leading edge and connected to a showerhead arrangement for film cooling discharge. A cooling air supply channel is located between the first leg and the second leg of the serpentine flow circuit, and the cooling supply channel includes ribs arranged to produce a vortex flow within the cooling air that collects the dirt particles within a center of the vortex flow and deposits the dirt particles at the bottom of the channel. The vortex flow cooling air flows through impingement holes to produce impingement cooling on the backside wall of the leading edge with clean cooling air. The vortex flow pattern produces higher flow velocities at the outer periphery of the vortex which produces a higher impingement jet velocity of the cooling air to improve convection and impingement cooling capability.

5 Claims, 1 Drawing Sheet

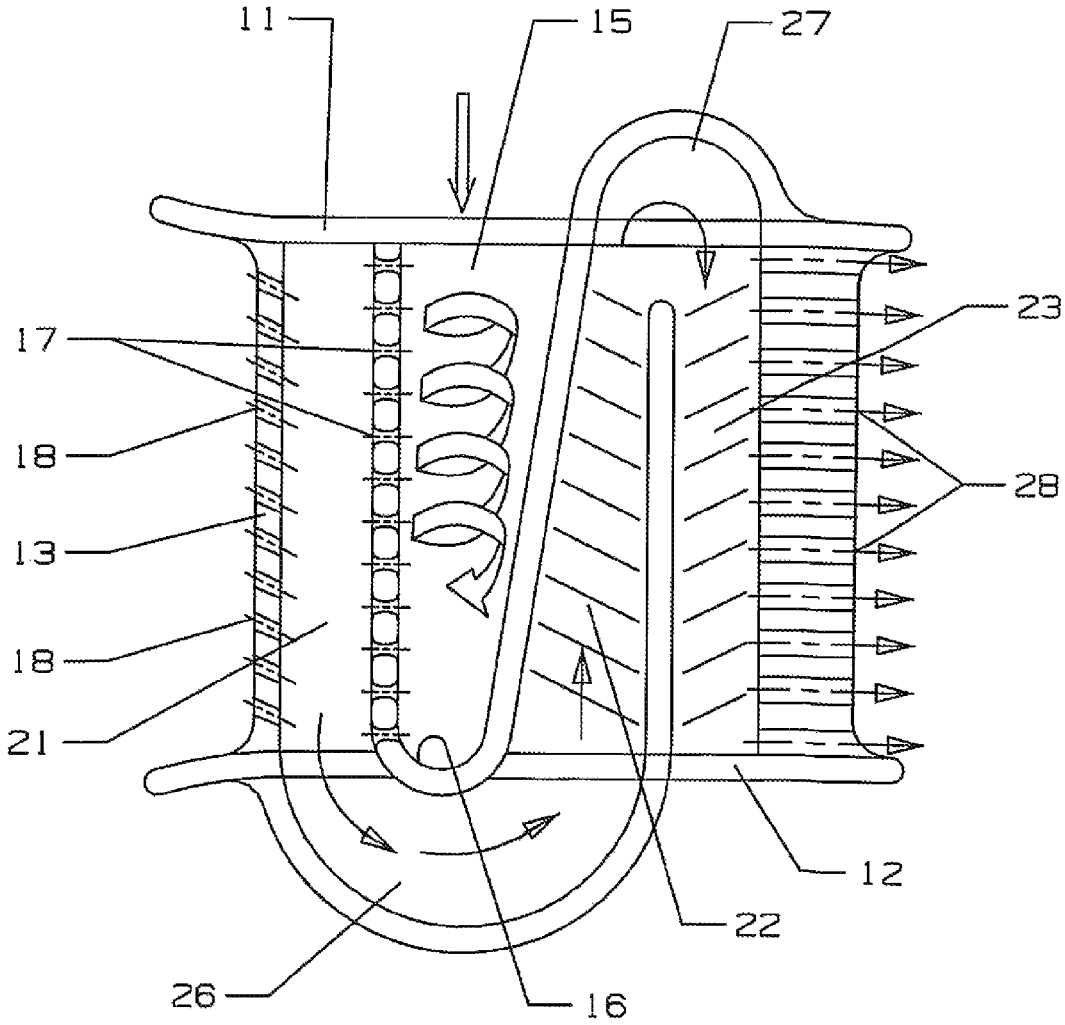
11
15
27
17
23
18
28
13
18
21
12
22
26
16

TURBINE VANE WITH DIRT SEPARATOR

CROSS-REFERENCE TO RELATED APPLICATIONS

This application is a CONTINUATION of U.S. patent application Ser. No. 12/489,030 filed on Jun. 22, 2009 and entitled TURBINE VANE WITH DIRT SEPARATOR; now U.S. Pat. No. 8,142,153 issued on Mar. 27, 2012.

GOVERNMENT LICENSE RIGHTS

None.

BACKGROUND OF THE INVENTION

1. Field of the Invention

The present invention relates generally to a gas turbine engine, and more specifically to a turbine stator vane with a dirt separator.

2. Description of the Related Art including information disclosed under 37 CFR 1.97 and 1.98

A gas turbine engine, such as an industrial gas turbine (IGT) engine, includes a turbine with multiple rows or stages or stator vanes that guide a high temperature gas flow through adjacent rotors of rotor blades to produce mechanical power and drive a bypass fan, in the case of an aero engine, or an electric generator, in the case of an IGT. In both cases, the turbine is also used to drive the compressor.

In the turbine section of the gas turbine engine, stages or rotor blades and stator vanes are used to guide the hot gas flow through and react with the rotor blades to drive the engine. To improve engine efficiency, the upstream stages of these airfoils (vanes and blades) are cooled with cooling air to produce convection cooling, impingement cooling, and even film cooling of the outer airfoil surfaces in order to allow for exposure to higher gas flow temperatures. The higher the turbine inlet temperature of the turbine, the higher will be the turbine efficiency and thus the engine efficiency. However, the highest temperature allowed is dependent upon the material properties of these airfoils, especially for the first stage airfoils, and the amount of cooling provided.

Higher levels of cooling can be used for these airfoils. However, since the pressurized cooling air is from the compressor, the more cooling air used from the compressor the more compressed air and work performed by the compressor that is not turned into useful work by the engine. The engine efficiency also decreases due to the extra work performed on compressing the cooling air which is then discharged into the hot gas flow so that no work is performed.

Turbine airfoils that include film cooling holes also suffer from plugging due to dirt particulates in the cooling air that reach a film cooling hole and block it or significantly reduce the amount of cooling air flowing through the semi-blocked hole. Film cooling holes with partially or fully blocked holes will result in a hot spot occurring around the hole. Hot spots lead to high metal temperature problems and erosion problems that significantly reduce the LCF (low cycle fatigue) of the airfoil which decreases the useful life of the airfoil.

BRIEF SUMMARY OF THE INVENTION

It is an object of the present invention to provide for a turbine stator vane with improved cooling over the prior art turbine vanes.

It is another object of the present invention to provide for a turbine stator vane with a dirt separator to prevent dirt particulates from blocking a film cooling hole.

It is another object of the present invention to provide for a turbine stator vane with a higher velocity in the cooling air that produces impingement cooling for the backside wall of the leading edge.

These objectives and more can be achieved by the turbine stator vane with the vortex cooling circuit of the present invention that produces a vortex flow in the cooling supply channel of the vane, where the vortex flow produces a higher velocity flow at the outer periphery of the vortex cooling feed channel which generates a higher rate of internal heat transfer coefficient and thus provides higher cooling effectiveness for the cooling of the airfoil pressure and suction side walls. The vortex flow of the cooling air will provide for a high strength of impingement jet velocity to the airfoil leading edge backside of the first up pass of a serpentine flow cooling channel.

The cooling air supply channel for the vane which produces the vortex flow also functions to collect any dirt particles flowing within the supply cooling air before the cooling air is passed through impingement holes to provide impingement cooling for the backside wall surface of the airfoil leading edge. The vortex flow collects the dirt particles and confines the particles in a dirt collection pocket located at the bottom end of the vortex channel. The clean cooling air then passes through a 3-pass aft flowing serpentine circuit to provide cooling for the airfoil.

BRIEF DESCRIPTION OF THE SEVERAL VIEWS OF THE DRAWINGS

FIG. 1 shows a cross sectional side view of the internal cooling circuit of the stator vane for the present invention.

DETAILED DESCRIPTION OF THE INVENTION

The present invention is a turbine stator vane for a gas turbine engine of the industrial gas turbine type. However, the stator vane could be used in an aero engine as well. FIG. 1 shows a cross section view of the stator vane cooling circuit of the present invention. The stator vane includes an outer endwall 11 and an inner endwall 12 with an airfoil 13 extending between the two end walls 11 and 12 to form the stator vane. Stator vanes typically are formed as segments in which one segment will have one or more airfoils extending between the two end walls. The cooling circuit with the dirt separation pocket can be used in any of these vane segment embodiments.

The stator vane embodiment shown includes a 3-pass aft flowing circuit to provide cooling for the entire airfoil section of the vane. The vane includes a cooling air feed or supply channel 15 with an arrangement of ribs that produce a vortex flow pattern in the cooling air flowing through the channel 15. At a lower end of the cooling air supply channel 15 is a dirt collector pocket that will collect any dirt particles flowing along with the vortex flowing cooling air within the supply channel 15. A row of impingement holes 17 are formed in the vortex channel 15 that connect to a first leg or channel 21 of the 3-pass serpentine flow cooling circuit located along the leading edge of the airfoil.

The first leg 21 of the serpentine circuit is located along the leading edge and includes a showerhead arrangement of film cooling holes 18 to discharge film cooling air onto the outer surface of the leading edge region of the airfoil. The first leg 21 is connected to a second leg 22 through an inner diameter turn channel 26, and the third leg 23 is connected to the second leg 22 through an outer diameter turn channel 27. The third or last leg 23 of the serpentine circuit is located along the trailing edge region of the airfoil and is connected to a row of exit cooling slots 28 to discharge the spent cooling air from the airfoil and cooling the trailing edge region. In all of the legs of the serpentine circuit, trip strips are used on the side walls to promote heat transfer to the cooling air flow.

The stator vane with the 3-pass aft flowing serpentine circuit and the vortex flow cooling air supply channel can all be formed at the same time using the well known investment casting process with the lost wax process. The film cooling holes and even the exit slots can be formed after the vane has been cast using any well known drilling process such as EDM or laser drilling of the holes and slots. The present embodiment uses a 3-pass aft flowing serpentine circuit for the vane. However, a 5-pass aft flowing serpentine circuit could also be used with the vortex flowing cooling air supply channel located between the first leg and the second leg and still produce the desired improved cooling capability and the dirt separation.

In operation, the vortex flow is generated in the vortex channel 15 by the injection of the cooling air into the vortex flow cooling air feed channel 15 through a swirl generator located along the wall of the channel 15. The vortex flow cooling air, which flows toward the inner endwall through the vane cooling air supply channel 15 while swirling, produces a higher pressure and a higher flow velocity at an outer periphery of the vortex flow, and becomes lower in pressure and lower in velocity at the bottom end of the channel 15. The higher rate of flow velocity at the outer periphery of the vortex flow will generate a higher rate of internal heat transfer coefficient and thus provide for a higher cooling effectiveness for the cooling of the airfoil pressure and suction side walls. This higher velocity of cooling air flow in the outer periphery of the vortex provides for a higher impingement jet velocity for the cooling air that impinges against the airfoil leading edge backside in the first leg 21 of the serpentine flow circuit. Helical ribs or skew fins in the radial direction of the channels are used on the cooling feed channel inner walls to augment the internal heat transfer performance as well as enhance the vortex flow motion within the cooling supply channel.

In addition to the cooling phenomena that occurs in the vortex feed channel 15 for cooling purposes, the vortex cooling feed channel 15 also functions as a dirt separator. The dirt particles flow toward the center of the vortex axis and subsequently are accumulated at the center bottom of the vortex cooling feed channel 15 in the pocket 16.

An inline arrangement for the position of the vortex cooling feed channel 15 to the vane leading edge cooling channel 21 will provide a directed cooling air delivery into the vane radial flow channel and thus minimize all cooling air pressure loss associated in the vane leading edge region and maximize the potential use of the cooling air pressure if a showerhead arrangement of film cooling holes is used for the airfoil leading edge cooling. In addition, dirt particles within the vortex cooling air flow will flow in a straight line and into the bottom of the cooling supply channel 15 to be collected in the end of the channel in the pocket 16. This particular cooling channel alignment enables the removal of the dirt particles for an air cooled serpentine flow circuit blade and eliminates dirt particles from the cooling air for the downstream serpentine flow circuit as well as the airfoil trailing edge cooling holes. As a result of the cooling air delivery circuit of the present invention, a lower cooling pressure loss is formed and a dirt particle free cooling air flow is obtained for the serpentine flow circuit which achieves a higher cooling air potential for use in cooling of the vane.

I claim the following:

1. An air cooled turbine stator vane comprising:

an outer endwall and an inner endwall;

an airfoil extending between the outer endwall and the inner endwall;

a cooling air supply channel positioned within the airfoil;

the cooling air supply channel having an arrangement of ribs along the walls to produce a vortex flow within the cooling supply air; and, a dirt collector pocket located on a bottom of the cooling air supply channel.

2. The air cooled turbine stator vane of claim 1, and further comprising:

a row of impingement cooling holes connecting the cooling air supply channel to a leading edge impingement cooling channel.

3. The air cooled turbine stator vane of claim 1, and further comprising:

a showerhead arrangement of film cooling holes connected to the leading edge impingement cooling channel.

4. The air cooled turbine stator vane of claim 1, and further comprising:

the cooling air supply channel has a decreasing cross sectional flow area.

5. The air cooled turbine stator vane of claim 1, and further comprising:

the cooling air supply channel extends from the outer endwall to the inner endwall.

* * * * *